United States Patent [19]

Creveling et al.

[11] Patent Number: 4,918,488

[45] Date of Patent: Apr. 17, 1990

[54] SCAVENGING APPARATUS

[75] Inventors: Clyde M. Creveling, Rochester; Carl R. Bothner, Brighton; Timothy G. Armstrong, Greece; Richard A. Weitzel, Hilton, all of N.Y.

[73] Assignee: Eastman Kodak Company, Rochester, N.Y.

[21] Appl. No.: 371,488

[22] Filed: Jun. 26, 1989

[51] Int. Cl.[4] ..... G03G 21/00

[52] U.S. Cl. ..... 355/296; 355/305

[58] Field of Search ..... 355/297, 296, 305, 303, 355/269

[56] References Cited

U.S. PATENT DOCUMENTS

| | | | |
|---|---|---|---|
| 3,543,720 | 12/1970 | Drexler et al. . | |
| 3,659,311 | 5/1972 | Waren . | |
| 4,014,065 | 3/1977 | Hudson . | |
| 4,043,298 | 8/1977 | Swackhamer | 355/305 X |
| 4,116,555 | 9/1978 | Young et al. . | |
| 4,165,171 | 8/1979 | Lemmen | 355/296 |
| 4,190,351 | 2/1980 | Macaluso et al. | 355/296 |
| 4,210,397 | 7/1980 | Macaluso et al. | 355/296 |
| 4,260,235 | 4/1981 | Stack . | |
| 4,349,270 | 9/1982 | Wada et al. . | |
| 4,435,073 | 3/1984 | Miller . | |
| 4,588,285 | 5/1986 | Tagoku | 355/303 X |
| 4,647,186 | 3/1987 | Armstrong et al. | 355/296 |
| 4,797,708 | 1/1989 | Kasiske, Jr. et al. | 355/296 |

OTHER PUBLICATIONS

Research Disclosure, 24942 (Jan. 1985).

*Primary Examiner*—Fred L. Braun
*Assistant Examiner*—Sandra L. Hoffman
*Attorney, Agent, or Firm*—Tallam I. Nguti

[57] ABSTRACT

Scavenging apparatus for removing substantially all unwanted particles from the image and non-image areas of an electrostatographic imaging member without appreciable adverse effects on the desired image remaining thereon, includes an alternating pole magnetic roller for rotatably creating a fast changing magnetic field, a stationary ac biased shell for enclosing the magnetic roller and for creating a low, but fast changing electrostatic field, and a low vacuum system. This apparatus combines the effects of such magnetic and electrostatic fields with those of the low vacuum system to gently loosen and effectively remove unwanted particles from the imaging member, without resort to relatively strong electrostatic field and vacuum values that are likely to adversely affect the desired loose toner image still on the imaging member.

9 Claims, 2 Drawing Sheets

SCAVENGING APPARATUS

BACKGROUND OF THE INVENTION

The present invention relates to apparatus in an electrostatographic copier or printer for removing unwanted image-defect causing particles from an imaging member which has a loose toner image thereon. More particularly, the present invention relates to such an apparatus that gently loosens and effectively removes substantially all such image-defect causing particles without adversely affecting the desired loose toner image remaining on the imaging member.

The process of producing or reproducing copies of images in an electrostatographic copier or printer involves moving an imaging member, in the form of a rigid drum or flexible web, past a series of stations. As this occurs, the imaging member is first charged, and then exposed to form a latent charged image thereon. The latent image is thereafter developed or made visible by moving it past a development station where charged, pigmented toner or particles of development material are attracted to and held by the latent image charges. The developed image is subsequently transferred, at a transfer station, to a suitable receiver, such as a copy sheet of paper which is thereafter advanced through a fusing station. At the fusing station, the toner particles forming the desired image on the copy sheet are heated and fused. Any particles remaining on the imaging member are thereafter removed, at a cleaning station, for example, using a cleaning fiber brush, prior to again charging the imaging member as the first step in repeating the process.

Despite such cleaning, some paper dust, pieces of brush fibers and other mostly airborne particles within the copier or printer, may thereafter be attracted to and remain on the imaging surface of the imaging member. Such particles usually result in image defects, if transferred, at the image transfer station, to the copy sheet of paper along with the desired image. As such, they are unwanted and should be removed prior to such image transfer. Additionally, other unwanted particles, which must also be similarly removed include carrier particles, usually ferromagnetic, which carry individual (wanted) particles of toner, and large agglomerated toner-toner particles or flakes of toner commonly present in development material. These latter particles are attracted to the latent image on the imaging member during development, along with individual wanted toner particles that will form the desired image. The carrier particles, which are heavier and larger than the toner particles they carry, ordinarily are not supposed to transfer as such to the latent image during development. The ones that unfortunately do transfer are therefore a problem because they cause image defects such as black spots, image voids and halftones, when transferred, at the transfer station, to the copy sheet along with the wanted, fine toner particles forming the desired image.

To attempt to prevent such image defects, various conventional apparatus have been developed for removing such unwanted particles from the image and/or non-image areas of the surface of the imaging member, prior to the desired image being transferred, at the transfer station, to the receiver or copy sheet. For example, a fixed magnet type scavenging apparatus is disclosed in commonly-assigned U.S. Pat. No. 3,543,720, which issued on Dec. 1, 1970 in the names of R. A. Drexler et al. Another example, which includes electrostatic charging, is disclosed in U.S. Pat. No. 4,435,073.

Additionally, it is also known to use positive air pressure apparatus for removal of toner-toner agglomerations or "tent poles" of toner material from the loose toner image area on a photoconductor. An example of this type of apparatus is disclosed in Item 24942 found on pages 73 and 74 of the January, 1985 edition of *Research Disclosure,* published by Kenneth Mason Publications Limited, the old Harbourmaster's, 8 North Street, Emsworth, Hampshire P.0. 10 7DD, England. A variation of this type of apparatus uses a vacuum or negative air pressure. See, for example, U.S. Pat. No. 4,014,065, issued Mar. 29, 1977 in the name of F. W. Hudson, which discloses a vacuum system for removing unwanted particles from the background area of a photoconductor.

In all such apparatus, there is a need to make the particular magnetic, electrostatic or pneumatic, particle removing component employed by the apparatus as strong as Possible, in order for it to be effective in removing the unwanted particles in a direction substantially normal to the surface of the imaging member. However, there is a limitation with making, for example, the electrostatic field or the pneumatic field alone as strong because each can then begin to destroy or adversely affect the loose toner image remaining on the imaging member. This limitation, together with the fact that the polarity and quantity of charges on all particles on the image and non-image areas of the imaging member are never fully known, have tended to substantially limit the effectiveness of such conventional scavenging apparatus.

Furthermore, since those Particles that are unwanted may be of the same polarity.(toner-toner or flakes), of opposite polarity (toner-carrier), or of unknown polarities (paper dust, brush fibers, etc.), a conventional scavenging apparatus employing only a vacuum effect, a fixed or slow moving magnetic field effect, or only the effect of a fixed single Polarity electrostatic field, will not sufficiently be effective in gently loosening and removing such Particles without also adversely affecting the desired image.

SUMMARY OF THE INVENTION

It is an object of the present invention to provide a scavenging apparatus for removing unwanted particles from both the image and non-image areas of an imaging member after development, without adversely affecting the desired , loose toner image remaining on the imaging member.

It is another object of the present invention to provide a scavenging apparatus that gently loosens and effectively removes unwanted particles from the image and non-image areas of an imaging member without adversely affecting the loose toner image remaining on the imaging member.

In accordance with the present invention, a scavenging apparatus for removing unwanted particles from an imaging surface includes a conductive shell that is connected to a low source of biasing electrical potential, a strong magnetic roller disposed inside the shell and creating a strong magnetic field thereabout, and a low vacuum system. According to a preferred embodiment, the shell which is electrically biased and stationary, is supported spaced from the imaging surface of the imaging member. As a result it generates an electrostatic field thereabouts that reaches the imaging surface. The electrostatic field however should alone not be strong enough to fully attract particles away from the imaging surface, but should just be strong enough to loosen the unwanted particles electrostatically from such surface without adversely affecting the wanted loose toner particles still forming the desired image thereon.

The magnetic roller is rotatable, and the magnetic field it creates about the shell is for attracting and removing from the imaging surface, any particles that are magnetizable. Finally, the vacuum system which has an inlet port supported adjacent the shell, spaced from the imaging surface of the imaging member, is particularly useful for removing light non-magnetic unwanted particles from the image and non-image areas of the imaging surface, as well as, for pneumatically augmenting the otherwise magnetic and electrostatic removal of particles by the magnetic roller and the biased shell respectively.

BRIEF DESCRIPTION OF THE DRAWINGS

In the detailed description of the preferred embodiment of the present invention below, reference is made to the accompanying drawings, in which.

DESCRIPTION OF A PREFERRED EMBODIMENT

Figure 1:
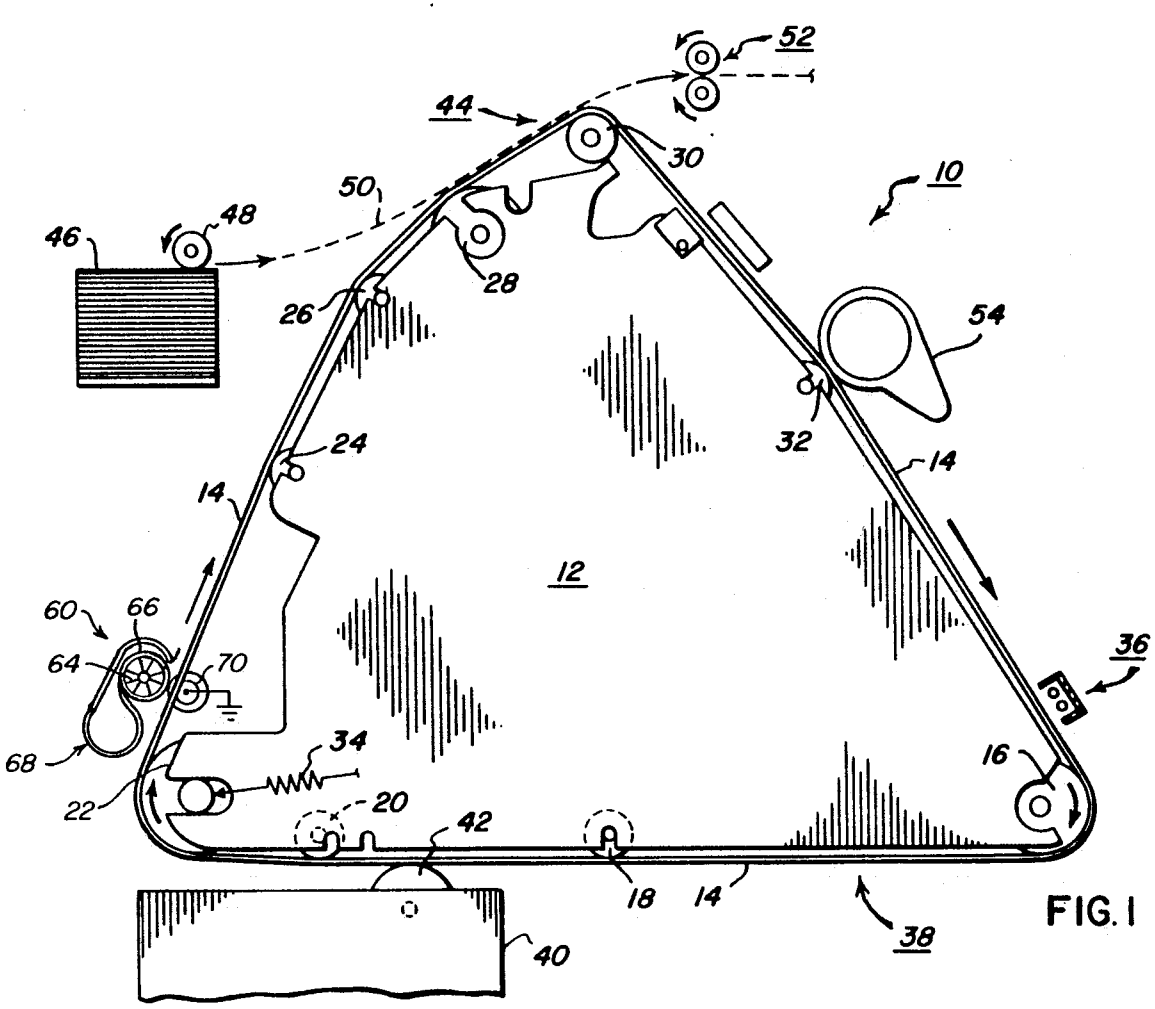
FIG. 1 is a schematic elevational view of a portion of an electrostatographic copier or printer incorporating the scavenging apparatus of the present invention.

Referring initially to FIG. 1, electrostatographic apparatus generally designated 10 includes a plate 12 that forms part of a framework for supporting an imaging member, for example, an endless flexible photoconductor 14, for movement in a clockwise direction as indicated by the arrows. As shown, the photoconductor 14 is supported by a driver roller 16 and a plurality of idler rollers 18, 20, 22, 24, 26, 28, 30 and 32. It is understood that the imaging member can also be a rigid drum that is rotably moved in the direction of the indicated arrows.

The imaging member or photoconductor 14 is driven through an imaging process starting with a charging station 36 where a substantially uniform layer of electrostatic charges of a known polarity, for example, a negative polarity (FIG. 2), is applied to the outer surface 15 of the photoconductor. The photoconductor 14 is next driven through an imaging station 38 where it is, for example, exposed to light rays in order to selectively discharge charges from some areas of the surface 15 leaving charges in other areas thereby forming an electrostatic latent image on the surface 15. The photoconductor 14 next moves past a development station 40, illustrated as having a magnetic brush 42, where pigmented marking particles, such as loose toner particles, are used to make the electrostatic latent image visible. The toner particles so used have a charge that is opposite in polarity to the charges forming the latent image on the photoconductor. As such, the toner particles will transfer by electrostatic attraction from the magnetic brush 42 to the latent image on the surface 15 of the photoconductor 14.

The latent image thus developed is next moved by the photoconductor 14 to a transfer station in the area designated 44, where the image, still in the form of loose toner particles, is transferred from the photoconductor to a suitable receiver, such as a copy sheet of paper. As shown, the copy sheet is fed from a stack of such sheets 46, by a sheet feed mechanism 48 along a path 50, to the transfer station 44. After the image has been transferred to it at the transfer station, the sheet is separated from the surface 15 of the photoconductor 14, and delivered to a fusing station 52 where the loose toner particles forming the desired image are fused to such copy sheet to form a finished copy. The finished copy is then delivered to a tray where it is accessible by a machine operator.

After leaving the transfer station, the photoconductor 14 passes through a cleaning station 54 where it is cleaned so that any residual toner particles or other materials thereon are removed prior to the photoconductor reaching the charging station 36 to again start the imaging process.

Figure 2:
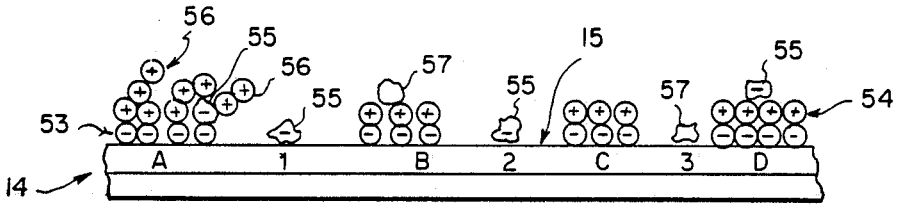
FIG. 2 is a schematic illustration of the cross-section of an electrostatographic imaging member, after development, carrying loose toner and other particles in image and non-image areas.

Referring now to FIG. 2, a cross-section of the imaging member, for example, the photoconductor 14, after passing through the development station 40, is illustrated carrying a layer of electrostatic charges 53 which were initially laid down on the photoconductor at the charging station 36 (FIG. 1). Also illustrated are a layer of individual thermoplastic (wanted) toner particles 54 and some undesirable ferromagnetic carrier particles 55, all of which were attracted from the development station 40. Other particles such as toner-toner flakes 56, and paper dust or pieces of brush fibers 57, which are incidental to the imaging process, may also be found on the imaging surface at this stage of the process. FIG. 2 also illustrates the image areas of the imaging member as A, B, C and D, and the non-image areas as 1, 2 and 3. The desired loose toner image is represented by the layer, for example, of the negative polarity latent charges 53 within the image areas A, B, C, and D shown attracting and electrostatically holding, for example, the monolayer of positive, that is, opposite polarity wanted toner particles 54. All the other particles, for example, the carrier particles 55, the excess layer of toner-toner agglomerated particles 56, and the paper dust or fiber particles 57, are unwanted particles which must be removed before the desired image is transferred at the station 44, in order to prevent image defects in the finished copy.

In the apparatus 10, the removal of such unwanted particles is accomplished by the scavenging apparatus of the present invention generally designated 60. Apparatus 60, as shown in FIG. 1, is located after the development station 40, but before the transfer station 44, and operates to gently loosen and effectively remove unwanted particles from the image (A, B, C and D) and non-image areas (1, 2 and 3) of the imaging member 14 without adversely affecting the wanted particles 54 still forming the desired loose toner image remaining on the surface 15. As shown in FIG. 1, the scavenging apparatus 60 includes in combination, a rotatable magnetic roller 64, an electrically biased shell 66, a vacuum system 68 and a backup roller 70.

Figure 3:
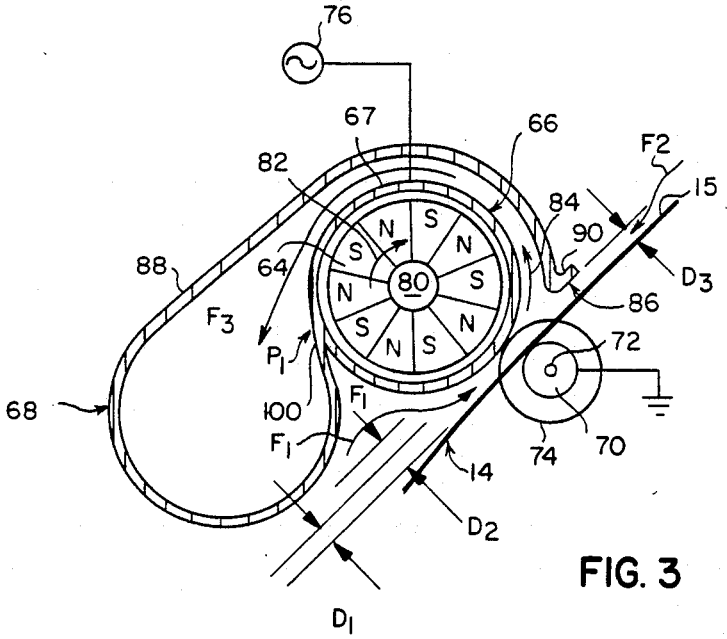
FIG. 3 is an enlarged cross-sectional view of the apparatus of the present invention.

As best shown in FIG. 3, scavenging apparatus 60 includes the shell 66 which has an outer surface 67 and is longer than the width of the imaging member 14 so as to extend appreciably beyond the edges of the member 14. Shell 66 is supported within the copier or printer so that it is stationary and spans the width of the imaging member 14 while being spaced a small distance $D_1$ therefrom. In copiers or printers that use a flexible web as the imaging member 14, as shown in FIG. 3, such imaging member will be made to ride over the backup roller 70. Roller 70 is rotatably supported within the copier or printer so as to maintain a constancy in the spacing $D_1$ of the imaging surface 15 from the shell 66. The distance $D_1$ should be large enough to prevent any direct contact between the surface 67 of the shell 66 and the particles on the surface 15, particularly the wanted toner particles 54 forming desired loose toner images thereon.

Backup roller 70 which rotates about a shaft 72, is grounded in order to dissipate any electrostatic charges that may tend to build up on the backside of the imaging member 14. To help assure maintenance of the distance $D_1$ between the shell 66 and the surface 15, the shell 66 is made to contact spacing rollers 74 which are disposed rotatably on the common shaft 72 with, and at each end of, the backup roller 70.

The shell 66 is conductive and is connected to a source of electrical potential 76. The source 76 is an a.c. biasing source that creates a fast changing electrostatic field about the shell 66, especially in the region between the shell and the surface 15. The spacing rollers 74, therefore, additionally serve to electrically insulate the imaging member 14 from the biased shell 66. The primary purpose of the source 76 is for electrostatically loosening, not necessarily removing, the unwanted particles from the surface 15. As such, the source 76 does not have to be very strong, and in order to avoid adversely affecting the desired image formed by the wanted particles 54, it should only be strong enough to create a low electrostatic field relative to the field holding the individual (wanted) toner particles to the surface 15. As an example, where the spacing distance $D_1$ is about 0.030 inch, an a.c. biasing potential of about 650 Vac, at a frequency of 600 Hertz, has been found to be most effective in electrostatically loosening unwanted particles for removal from an imaging surface, without adversely affecting the desired image remaining thereon.

As the imaging member illustrated in FIG. 2 approaches the region (which we will call here the scavenging zone) between the biased shell 66 and the backup roller 70, the ac biasing source 76 creates a relatively low, fast changing electrostatic field within the scavenging zone. Biased as such, the shell 66 electrostatically begins to "rock", in and out, unwanted carrier and other unwanted particles 55, 56 and 57, that are otherwise being held to the surface 15 electrostatically. Such an electrostatic "rocking" motion functions to gently loosen the unwanted particles from the surface 15, thereby facilitating their removal therefrom. On the other hand, the wanted toner particles 54, because they are much smaller than the unwanted carrier particles 55, or the flake particles 56, adhere more tightly to the surface 15 than such larger unwanted particles, and will therefore not be similarly loosened or otherwise adversely affected by such "rocking" motion.

Once loosened as such, the larger unwanted particles can then be removed from the imaging surface 15 of the member 14, if sufficient forces tending to remove them therefrom are applied. Note that the need to minimize the relative strength of the electrostatic field means that the electrostatic field may not be strong enough alone to also then cause the loosened particles to electrostatically transfer from the member 14 to the shell 66. Additionally, since the scavenging apparatus 60, relative to the imaging member 14, may be located at a point on an upward rising portion of the member 14, gravitational forces may cause the unwanted carrier particles 55, because of their greater weight, to tend instead to fall downwards along the imaging surface 15, if the forces for removing them in a direction substantially normal to such surface, for example, the electrostatic attraction forces of the field of the source 76 alone, are not strong enough.

Therefore, the apparatus 60 further includes the magnetic roller 64 which is supported rotatably within the shell 66. Roller 64 is supported by, and rotates about a shaft 80, which as shown may be located so that the roller 64 is concentric with the shell 66. The shaft 80 may also be located so that the roller 64 is eccentric with the shell 66 such that the roller rotates closer to that portion of the wall of the shell facing the imaging member 14. In either case, the roller 64 should be supported so that it rotates freely inside the shell 66, and thus at a small distance $D_2$ from the surface 15 of the imaging member 14.

As shown in FIG. 3, the roller 64 consists of alternating N and S pole segment magnets (10 poles are illustrated) that are each strong enough to create a strong magnetic field about the shell 66, particularly within the scavenging zone between the shell 66 and the imaging surface 15 of the member 14 during rotation. A field of $750 \pm 50$ Gauss strength was found to be enough at a distance $D_2$ of about 0.070". The purpose of the magnetic field is to attract and remove from the surface 15 any magnetizable particles, such as the ferromagnetic carrier particles 55, which have been loosened electrostatically by the biasing source 76, as described above.

Combining the effect of the relatively low fast changing electrostatic field and that of the magnetic field is especially useful in gently loosening and cleanly removing unwanted magnetizable carrier particles which undesirably transferred to the surface 15 buried in wanted particles of non-magnetic toner. Ordinarily, attempting to loosen and remove such a buried carrier particle, merely by the strength of the strong magnetic field, may result in a scattering of the non-magnetic toner particles burying it, thereby further aggravating the risk of image defects. In the apparatus of the present invention, the combination of the in and out "rocking" motion of the fast changing electrostatic field with the magnetic attraction of the roller 64, operate to gently loosen and cleanly remove such a buried particle, without scattering any of the wanted toner particle burying it.

Operatively, roller 64 should be rotated, for example, in the direction of arrow 82 and at a sufficiently high rate of speed so as to create a continuous and fast changing magnetic field thereabout. Such rotation causes the roller 64 to have a continuous and substantially a "peeling" effect in removing the magnetizable particles 55 from the imaging surface 15. The net result is that no "bands" or regions of high and low particle removal, will be formed across the imaging surface 15, as can be the case with fixed or slow magnetic field scavenging apparatus.

Magnetizable particles removed from the imaging surface by the combined effects of the electrostatic and magnetic fields, as described above, will be pulled to the surface 67 of the shell 66. The rotation of the magnetic roller in the direction of the arrow 82 (clockwise) will cause the magnetizable particles to be attracted to the approaching magnetic pole and, hence, to creep in the opposite or counterclockwise direction as shown by arrow 84.

Unlike the magnetizable carrier particles 55, the non-magnetic and larger toner flakes 56, and the other unwanted particles 57 (such as paper dust and pieces of brush fibers), cannot similarly be loosened and removed, as above, by the mere combination effects of the electrostatic and magnetic fields. Therefore, the apparatus 60 additionally includes a vacuum system 68 that is connected to a vacuum source (not shown) downstream, and to an elongate nozzle 86 that as shown, is partially wrapped around the shell 66. The primary purposes of the vacuum system are (a) to act on and remove the large non-magnetic unwanted particles 56 from the imaging surface 15, and (b) to transport all particles removed from the imaging surface 15, through the plenum 88 of the vacuum system 68, to a collection point (not shown) downstream. Accordingly, the nozzle 86 has a lip 90 that is spaced a small distance $D_3$ from the imaging surface 15 at a point just downstream of the scavenging zone or area directly between the shell 66 and the imaging surface 15. As shown, in FIGS. 1 and 3, the effect of the vacuum system 68 is to pull into the nozzle 86 an airstream $F_1$ flowing in the direction of travel of the imaging surface 15, and an airstream $F_2$ flowing against such surface. The nozzle 86 is formed in part by a portion of the outside surface 67 of the shell 66 and by a portion of the wall of the plenum 88 that is curved to substantially follow, but be spaced from, such portion of the outside surface of the shell 66.

As a result, particles on the imaging surface 15, in and near the scavenging zone, are subjected to the influence of the vacuum system, as well as, are all particles moving on the outside surface 67 of the shell 66. Influenced as such, the toner flakes 56 and the other non-magnetic particles 57 will be airborne into the nozzle 86, and carrier particles on the surface 67 of the shell 66 will be urged on into the plenum 88.

The vacuum system 68 additionally functions to augment the tendency of particles otherwise magnetically and/or electrostatically being moved, in substantially a normal direction, away from the imaging surface 15 to the outside surface 67 of the biased shell 66. Since the heavier carrier particles 55 are also being moved magnetically, the vacuum system also does not have to be strong enough alone to be capable of removing such heavier particles in such manner.

Particles, being moved magnetically and pneumatically over the surface 67 of the shell 66 into the plenum 88, are skived from such surface 67 at a point $P_1$ which is about 180° circumferentially spaced from the scavenging zone. An edge 100 of the wall of the plenum 88 seals the plenum against the shell 66, and is adapted to function additionally as the skiving means at the point $P_1$. Particles such as the carrier particles 55, skived off as such into the plenum 88, and the particles such as 56 and 57 which are airborne through the nozzle 86 into the plenum 88, are thereafter transported by the continued effect $F_3$ of the vacuum system through the plenum, to a collection point, for example, the development material container of the development station 40.

The removal of unwanted particles from the imaging surface 15, in a direction substantially normal to such surface, by using a triple-effect combination of electrostatic, magnetic and pneumatic forces, is an important advantage of the present invention. Such a combination advantageously allows the use of relatively low electrostatic and pneumatic forces, thereby reducing the risk of otherwise relatively strong electrostatic or pneumatic forces adversely affecting the loose toner image remaining on the imaging surface.

Although the description of the present invention has been made with particular reference to a preferred embodiment, it is understood that modifications and variations can be effected within the spirit and scope of the invention.

We claim:

1. In an electrostatographic copier or printer in which desired latent images, formed on the imaging surface of an imaging member, are made visible with charged, loose particles of toner that are electrostatically attracted and held to the latent image at a development station, and in which the desired loose toner image, so developed, is thereafter transferred at a transfer station to a suitable receiver for fusing thereto, a scavenging apparatus for removing, prior to such desired image transfer, unwanted particles from the image and non-image areas of the imaging surface of such imaging member, without adversely affecting the wanted toner particles forming the desired image remaining thereon, the scavenging apparatus including:

(a) a conductive shell spaced from the imaging surface of the imaging member, said shell having an electrical potential source connected thereto creating an electrostatic field for electrostatically loosening such unwanted particles on the imaging surface without adversely affecting the wanted loose toner particles forming the desired image remaining thereon;

(b) a rotatable magnetic roller disposed inside said stationary shell, said magnetic roller creating a magnetic field about said shell for attracting and removing from the imaging surface, any loosened particles that are magnetizable; and (c) a vacuum system having a pickup nozzle, said pickup nozzle being adjacent said shell spaced from the imaging surface of the imaging member and said vacuum system being useful for pneumatically augmenting the removal of unwanted particles otherwise (i) magnetically being removed by said magnetic roller, and/or (ii) electrostatically under a removal tendency from said shell, as well as, being useful for pneumatically and directly removing non-magnetic unwanted particles from the imaging surface.

2. The apparatus of claim 1 wherein said electrical potential source connected to and biasing said shell, is an ac source.

3. The apparatus of claim 1 wherein said shell is stationary.

4. The apparatus of claim 1 wherein said magnetic roller consists of a plurality of alternating pole magnets for creating a fast moving and changing magnetic field that has a continuous and substantially "peeling" effect in removing magnetizable particles from the imaging surface of such imaging member so as to prevent the creation of "bands" of areas with varying amounts of particles removed therefrom.

5. The apparatus of claim 1 wherein said pickup nozzle is formed in part by a portion of the outside surface of said shell.

6. The apparatus of claim 1 further including a backup roller for the imaging member, and means for spacing said shell from the imaging surface of the imaging member.

7. The apparatus of claim 2 wherein said a.c. biased shell creates a fast changing electrostatic field which gently loosens unwanted particles from the imaging surface by inducing a substantially "in and out rocking" electrostatic motion in such unwanted particles.

8. The apparatus of claim 3 wherein said magnetic roller consists of ten alternating pole magnets.

9. The apparatus of claim 1 wherein said vacuum system additionally functions to transport particles removed from the imaging member, to a collection point.

* * * * *